US011110331B2

(12) United States Patent
Wilkinson

(10) Patent No.: US 11,110,331 B2
(45) Date of Patent: Sep. 7, 2021

(54) PUTTER COMPRISING SWIVELLING HANDLE AND PIVOTAL CLUB HEAD

(71) Applicant: Douglas Larry Wilkinson, Brandon (CA)

(72) Inventor: Douglas Larry Wilkinson, Brandon (CA)

( * ) Notice: Subject to any disclaimer, the term of this patent is extended or adjusted under 35 U.S.C. 154(b) by 0 days.

(21) Appl. No.: 16/868,925

(22) Filed: May 7, 2020

(65) Prior Publication Data

US 2020/0384323 A1 Dec. 10, 2020

Related U.S. Application Data

(60) Provisional application No. 62/857,912, filed on Jun. 6, 2019.

(51) Int. Cl.

| | |
|---|---|
| ***A63B 53/02*** | (2015.01) |
| ***A63B 53/14*** | (2015.01) |
| ***A63B 53/00*** | (2015.01) |
| *A63B 60/34* | (2015.01) |
| *A63B 60/20* | (2015.01) |

(52) U.S. Cl.

CPC ..... *A63B 53/14* (2013.01); *A63B 53/007* (2013.01); *A63B 53/02* (2013.01); *A63B 60/20* (2015.10); *A63B 60/34* (2015.10)

(58) Field of Classification Search

CPC ..... A63B 53/14; A63B 53/007; A63B 60/02; A63B 60/34; A63B 60/32; A63B 53/022; A63B 53/023; A63B 53/027; A63B 53/02; A63B 60/20; A63B 2225/09; A63B 53/0487; A63B 60/52

See application file for complete search history.

(56) References Cited

U.S. PATENT DOCUMENTS 2,445,718 A * 7/1948 Sternberg ..... A63B 53/007 473/204
4,252,317 A * 2/1981 Vezina ..... A63B 53/007 473/294

(Continued)

FOREIGN PATENT DOCUMENTS

JP 3122996 * 6/2006

*Primary Examiner* — Stephen L Blau
(74) *Attorney, Agent, or Firm* — Christopher J. Dynowski; Ryan W. Dupuis; Ade + Company Inc.

(57) ABSTRACT

A putter comprises a handle at an upper end of a shaft of the putter to be grasped by one hand of a user, while an upper portion of the shaft between the handle and the head is to be grasped by a second hand of the user. The handle is arranged for swiveling movement relative to the upper shaft portion along a predetermined angular path defined about a transverse handle axis distinct from a shaft axis so that the handle can be fixedly held by the user and the shaft displaced in forward swinging movement along the predetermined angular path for hitting a golf ball. A putter head is pivotally connected at a lower end of the shaft to be movable about a distinct transverse pivot axis between a starting position in which a hitting plane is substantially parallel to the shaft axis and oblique ending position in which the hitting plane forms an acute angle therewith, such that the hitting plane of the head can remain substantially normal to the support surface after initial contact with the golf ball during the forward swinging movement.

10 Claims, 5 Drawing Sheets

(56) References Cited

U.S. PATENT DOCUMENTS 4,736,951 A * 4/1988 Grant ..... A63B 53/04 473/246
4,778,180 A * 10/1988 Guenther ..... A63B 53/047 473/248
5,088,738 A * 2/1992 Mundt ..... A63B 69/3685 473/206
5,209,475 A * 5/1993 Loman ..... A63B 53/007 473/294
5,401,022 A * 3/1995 McCready ..... A63B 53/007 473/294
5,474,300 A * 12/1995 Scalise ..... A63B 53/007 473/201
5,595,385 A * 1/1997 Jablonski ..... A63B 53/14 473/295
5,746,662 A * 5/1998 Squire ..... A63B 69/3685 473/206
6,394,911 B1 * 5/2002 Vaughn ..... A63B 53/14 473/294
6,773,362 B1 * 8/2004 Choi ..... A63B 60/34 473/340
7,708,651 B2 * 5/2010 Shin ..... A63B 60/34 473/294
7,892,108 B2 * 2/2011 Kuo ..... A63B 53/007 473/314
8,506,417 B2 * 8/2013 Sansbury ..... A63B 60/20 473/294
D750,717 S * 3/2016 Falcon ..... D21/736
9,468,830 B2 * 10/2016 Paulson ..... A63B 60/16
2003/0236128 A1 * 12/2003 Jackson ..... A63B 53/007 473/244
2010/0255928 A1 * 10/2010 Sahoda ..... A63B 53/02 473/313
2015/0258390 A1 * 9/2015 DeFrancesco, Jr. . A63B 53/007 473/313
2017/0361179 A1 * 12/2017 Brandt ..... A63B 53/0487

* cited by examiner

PUTTER COMPRISING SWIVELLING HANDLE AND PIVOTAL CLUB HEAD

This application claims the benefit under 35 U.S.C. 119(e) of U.S. Provisional application Ser. No. 62/857,912 filed Jun. 6, 2019.

FIELD OF THE INVENTION

The present invention relates to a golf club and specifically a type of golf club particularly designed for putting a golf ball which is typically referred to as a putter, and more particularly to a putter having a rotatable handle and pivotal club head.

BACKGROUND

A conventional putter comprises an upright shaft, a head defining a front face for engaging a golf ball that is fixedly attached to the shaft, and a grip fixedly arranged at an upper end of the shaft for gripping the shaft about its shaft axis.

Generally, the head of the putter is displaced in a pendulum-like swinging movement with a fulcrum of this movement, that is, a pivot point thereof, generally located at the user's shoulders. Therefore, based on conventional practice in the sport of golf, movement of the shoulders through an arcuate path substantially defines an arcuate path of the head of the putter and consequently a path of the golf ball across a support surface such as a green. According to recommended technique, the putter is to be held and displaced through the forward swinging movement in a manner such that the arcuate path of the head substantially follows and is substantially concentric to the arcuate path travelled by the user's shoulders.

SUMMARY OF THE INVENTION

According to an aspect of the invention there is provided a putter for hitting a golf ball across a support surface comprising:

an upright shaft extending from a lower end to an upper end along a shaft axis, the shaft having intermediate the upper and lower ends a backside and a front side spaced forwardly from the backside;

a head supported at the lower end of the shaft and having a front face arranged generally at the front side of the shaft for engaging the golf ball in a forward swinging movement, the front face defining a hitting plane which is substantially parallel to the shaft axis;

a handle supported at the upper end of the shaft and defining a handle axis oriented transversely to the shaft axis and substantially parallel to the hitting plane for gripping by a first hand of a user in a putting stance of the user so as to orient the hitting plane substantially perpendicularly to the user positioned in the putting stance;

an upper portion of the shaft intermediate the handle and the head adapted for gripping by a second hand of the user;

the handle being arranged for swiveling movement relative to the upper portion of the shaft along a predetermined angular path about the handle axis so that the handle gripped by the first hand of the user can be maintained at a substantially fixed location to define a fulcrum of the forward swinging movement while the shaft is displaced by the second hand in the forward swinging movement along the predetermined angular path for hitting the golf ball in a prescribed direction defined by the predetermined angular path.

This arrangement allows the user to use the handle to aim the putter head and to displace the shaft, to which the head is attached so as to move therewith in the forward swinging movement, along a predictable path defined by the handle so that the golf ball is hit in a predictable direction defined by the relative movement between the handle and the shaft.

Preferably, the handle comprises an inner support body defining the handle axis and connected in fixed transverse relation to the upright shaft and an outer grip of the handle adapted for gripping by the first hand of the user and swivably supported by the support body for effecting the swiveling movement of the handle, the outer grip defining a slit extending angularly of the handle axis to define the predetermined angular path of the swiveling movement of the handle relative to the upper portion of the shaft.

In the illustrated arrangement, the outer grip is rotatably supported on the inner body so as to be freely rotatable relative thereto around the handle axis and the slit forms a closed slot which is cooperative with an upright connector member extending substantially axially of the shaft axis from the upper end of the shaft to the inner body of the handle to connect the handle to the shaft and passing through the slot of the outer grip to restrict the swiveling movement between starting and ending positions corresponding to opposite ends of the slot.

In the illustrated arrangement, an angular displacement of the handle from the starting position to the ending position is between about four degrees and about ten degrees relative to the handle axis.

Preferably, the head is pivotally connected to the shaft at a head pivot defining a pivot axis oriented transversely to the shaft axis and substantially parallel to the hitting plane and disposed rearwardly of the front face of the head, the front face of the head being movable in pivotal movement relative to the shaft about the pivot axis between a starting position in which the hitting plane is substantially parallel to the shaft axis and an oblique ending position in which the hitting plane is oriented so as to form an acute angle with the shaft axis such that the hitting plane can remain substantially normal to the support surface after initial contact with the golf ball during the forward swinging movement.

Preferably, the pivotal movement of the head from the starting position to the oblique ending position thereof is arranged so as to be responsive to the swiveling movement of the handle.

In the illustrated arrangement, the putter includes a control assembly for controlling the pivotal movement of the front face of the head between the starting and oblique ending positions, the control assembly comprising a movable link operatively coupled between the handle and the head at a location thereon rearward of the pivot axis and arranged in a manner so that the swiveling movement of the handle acts to displace the movable link so as to move the front face of the head from the starting position to the oblique ending position, and a resilient tensionable member which is operatively coupled between the head and the upright shaft and arranged to be tensioned when the front face of the head is in the oblique ending position so as to bias the front face back to the starting position.

In one arrangement, the resiliently tensionable member comprises longitudinally spaced apart first and second ends which are displaceable away from one another in a longitudinal direction of the member for tensioning the resiliently tensionable member, wherein the first end being coupled to the upright shaft and the second end being coupled to the front face of the head.

In another arrangement, the resiliently tensionable member comprises a spring arranged coaxially of the pivot axis with one end connected in fixed relation to the upright shaft and another end connected in fixed relation to the head and the spring is configured to be twisted around its axis for tensioning the spring.

In the illustrated arrangement, the handle is disposed at the end of the shaft and forms an elongate member extending along the shaft axis so as to generally collectively form a T-shape with the upper portion of the shaft.

According to another aspect of the invention there is provided a putter for hitting a golf ball across a support surface comprising:

an upright shaft extending from a lower end to an upper end along a shaft axis, the shaft having intermediate the upper and lower ends a backside and a front side spaced forwardly from the backside;

a head supported at the lower end of the shaft and having a front face arranged generally at the front side of the shaft for engaging the golf ball in a forward swinging movement, the front face defining a hitting plane which is substantially parallel to the shaft axis;

an upper portion of the shaft distal to the head being arranged for gripping by a user such that the hitting plane is oriented substantially perpendicularly to the user positioned in a putting stance;

the head being pivotally connected to the shaft at a head pivot defining a pivot axis oriented transversely to the shaft axis and substantially parallel to the hitting plane and disposed rearwardly of the front face of the head, the front face of the head being movable in pivotal movement relative to the shaft about the pivot axis between a starting position in which the hitting plane is substantially parallel to the shaft axis and an oblique ending position in which the hitting plane is oriented so as to form an acute angle with the shaft axis such that the hitting plane can remain substantially normal to the support surface after initial contact with the golf ball during the forward swinging movement.

Thus in such an arrangement the front face of the putter head maintains substantially a constant angle of attack relative to the golf ball even after initial contact therewith in the forward swinging movement.

In one arrangement:

the upper portion of the shaft comprises a handle supported at the upper end of the shaft and defining a handle axis oriented transversely to the shaft axis and substantially parallel to the hitting plane for gripping by a first hand of a user such that the hitting plane is oriented substantially perpendicularly to the user in the putting stance, and the upper portion of the shaft intermediate the handle and the head being adapted for gripping by a second hand of the user;

the handle being arranged for swiveling movement relative to the upper portion of the shaft from a starting position to an ending position in a rotational direction about the handle axis so as to permit restricted relative movement between wrists of the user's hands and the head of the putter during the forward swinging movement for hitting the golf ball; and the pivotal movement of the head from the starting position to the oblique ending position thereof being arranged so as to be responsive to the swiveling movement of the handle from the starting position to the leading ending position thereof.

In one such arrangement, the putter further includes a control assembly for controlling the pivotal movement of the front face of the head between the starting and oblique ending positions, the control assembly comprising a movable link operatively coupled between the handle and the head at a location thereon rearward of the pivot axis and arranged in a manner so that the swiveling movement of the handle acts to displace the movable link so as to move the front face of the head from the starting position to the oblique ending position, and a resilient tensionable member which is operatively coupled between the head and the upright shaft and arranged to be tensioned when the front face of the head is in the oblique ending position so as to bias the front face back to the starting position.

In one arrangement, the resiliently tensionable member comprises longitudinally spaced apart first and second ends which are displaceable away from one another in a longitudinal direction of the member for tensioning the resiliently tensionable member, wherein the first end being coupled to the upright shaft and the second end being coupled to the front face of the head.

In another arrangement, the resiliently tensionable member comprises a spring arranged coaxially of the pivot axis with one end connected in fixed relation to the upright shaft and another end connected in fixed relation to the head and the spring is configured to be twisted around its axis for tensioning the spring.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

In the accompanying figures is shown a golf club in the form of a putter 10 for hitting a golf ball 1 across a support surface S.

Figure 1:
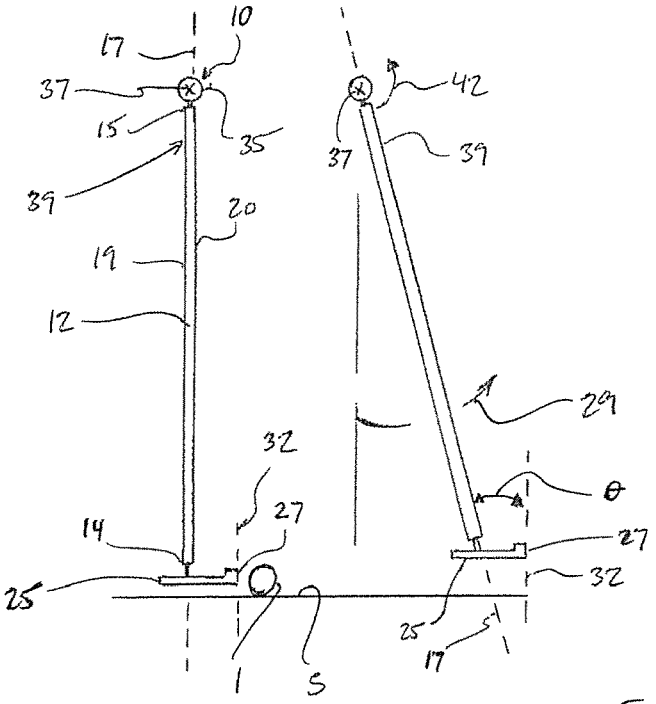
FIG. 1 is a schematic illustration of an arrangement of putter according to the present invention showing in side view relative positions of the putter during a forward swinging movement.
Figure 4:
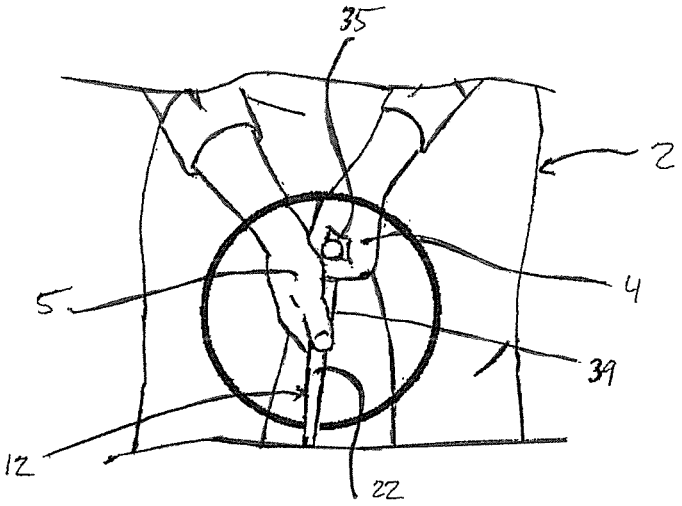
FIG. 4 is a schematic illustration of a user's hands gripping an upper portion of a putter.
Figure 5:
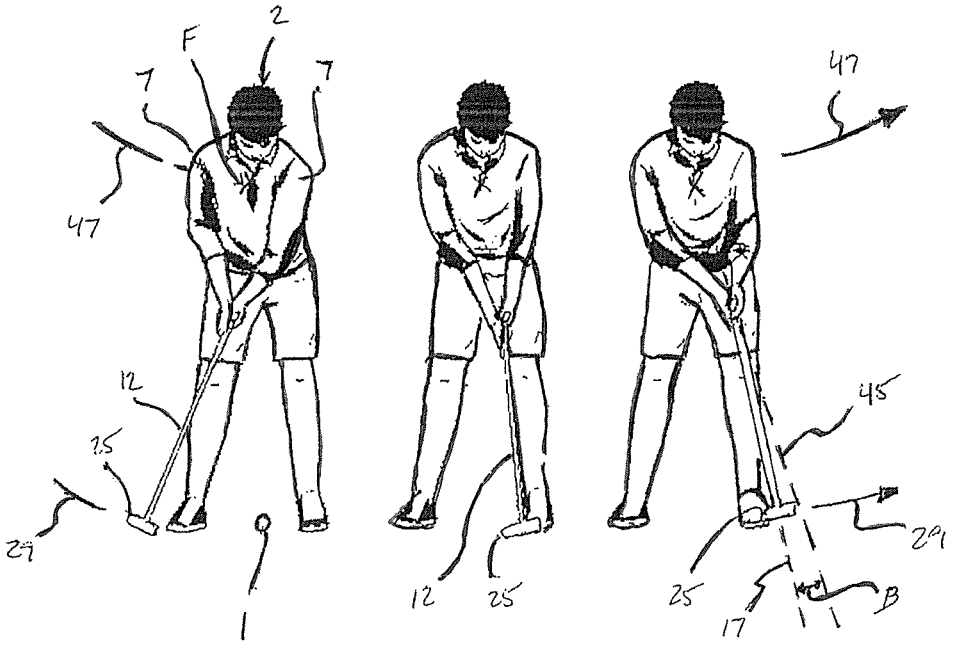
FIG. 5 is illustrates movement of a putter relative in a forward swinging movement to a user.

Referring to FIG. 1, the putter 10 comprises an upright shaft 12 extending from a lower end 14 to an upper end 15 along a shaft axis 17. Intermediate the lower and upper ends 14, 15 the shaft has a backside 19 and a front side 20 spaced forwardly from the backside 19. Referring to FIGS. 3A and 3B, the shaft 12 further includes, intermediate the lower and upper ends 14, 15 thereof, opposite sides 22, 23 one of which indicated at 22 is arranged to face away from a user 2 holding the putter 10 in a putting stance as shown in FIGS. 4 and 5 so as to be a distal side relative to the user, and the other 23 being arranged to face towards the user 2 so as to be a proximal side. As such, the front side 20 is arranged generally to face forwardly in the direction H in which the golf ball is to be hit.

For contacting the golf ball 1 the putter 10 comprises a head 25 supported at the lower end 14 of the shaft and having a front face 27 arranged generally at the front side 20 of the shaft for engaging the golf ball 1 in a forward swinging movement 29, as shown for example in FIG. 1. Thus the front face 27 is arranged to face in the direction H the ball is to be hit. The front face 27 defines a hitting plane 32 which normally is substantially parallel to the shaft axis 17 as shown in the left hand-side illustration of FIG. 1.

For handling the putter 10 it includes a handle 35 supported at the upper end 15 of the shaft and defining a handle axis 37 oriented transversely to the shaft axis 17 and substantially parallel to the hitting plane 32 for gripping by a first hand of the user, typically a leading hand 4, so as to orient the hitting plane 32 substantially perpendicularly to the user 2 positioned in the putting stance as shown in FIG. 5. Also, an upper portion 39 of the shaft intermediate the handle 35 and the head 25 is adapted for gripping by a second hand of the user, typically a trailing hand 5. It will be appreciated that in the putting stance of the user 2 typically the leading hand 4 is positioned forwardly of the shaft 12 in relation to the forward swinging movement 29, and the trailing hand 5 is positioned rearwardly of the shaft 12 relative to the forward swinging movement 29. Typically, the leading hand is the user's non-dominant hand and the trailing hand is the user's dominant hand. In the illustrated arrangement, the handle 35 forms an elongate member extending along the handle axis 37 and disposed at the end of the shaft 12 so as to be above the shaft such that a T-shape is collectively formed by the handle 35 and the upper shaft portion 39 which defines the upper end 15 of the shaft.

In the putting stance, the golf ball 1 is located generally centrally between the user's feet such that the user is straddling the ball 1, and the head 25 of the putter is positioned behind the ball relative to the hitting direction H so that the ball can be displaced in the hitting direction. Typically, the ball is located forwardly of a center between the user's feet in the putting stance.

Thus, in the example where the user is right-handed, as illustrated more clearly in FIG. 4, typically the user 2 places their non-dominant left hand 4 on the handle 35, with fingers thereof located on either side 22, 23 of the shaft 12 and wrapping around the handle axis 37, and the user's dominant right hand 5 is located on the shaft 12 generally at the upper end 15 thereof and below the non-dominant hand. Thus the hands of the user grip and hold the putter 10 at distinct locations which are axially spaced apart relative to the shaft axis 17.

Typically the handle 35, the shaft 12 and the head 25 of the putter are arranged coaxially of the shaft axis 17 so as to be in-line.

Conventionally, the putter is held by the user such that the shaft axis 17 is oriented radially of a fulcrum F of the forward swinging movement 29, and the forward swinging movement 29 as shown in fragments in FIG. 5 is substantially pendulum-like with the head 25 of the putter following an arcuate path with a substantially uniform radius relative to the fulcrum F across the arcuate path from a preparatory position generally to a trailing side of the user behind the ball 1 before it is hit to a follow-through position in which the putter head 25 is located forwardly of the preparatory position and generally at the leading side of the user after the initial contact with the ball 1.

When using a conventional putter, the fulcrum of the forward swinging movement of the putter head is defined at the shoulders with the shaft oriented radially thereof. Thus the shoulders are moved albeit slightly in a generally arcuate path and the putter head traverses a concentric arcuate path. However, in such movement the whole of the putter is displaced in the forward swinging movement and inadvertently changing the path of any portion of the user's body between the shoulders and the hands, which may include the hips, in the forward swinging movement may cause the struck golf ball to deviate from its intended path.

Thus the handle 35 is arranged for swiveling movement relative to the upper portion 39 of the shaft 12 along a predetermined angular path 41 about the handle axis 37 so that the handle 35 gripped by the first hand 4 of the user can be maintained at a substantially fixed location to define the fulcrum F of the forward swinging movement 29 while the shaft 12 is displaced by the second hand in the forward swinging movement along the predetermined angular path for hitting the golf ball in a prescribed direction defined by the predetermined angular path, as shown more clearly in FIG. 5.

Figure 2A:
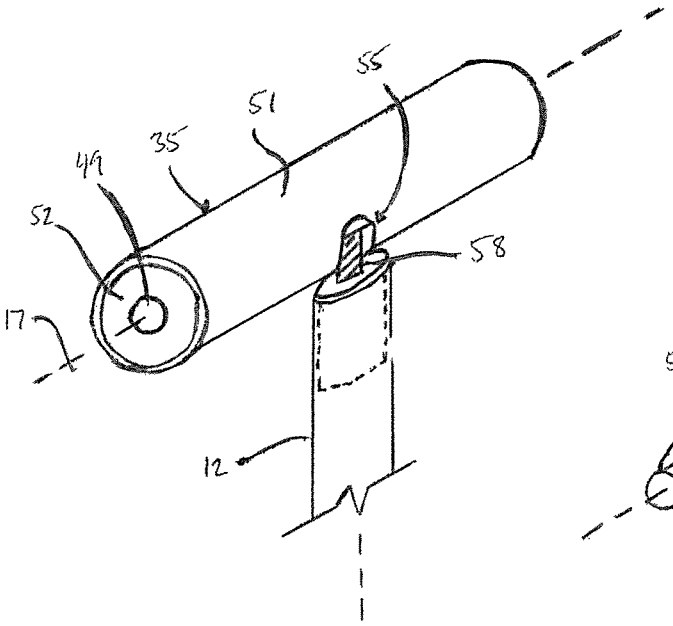
FIG. 2A is an enlarged perspective view of a handle of the arrangement of FIG. 1.
Figure 2B:
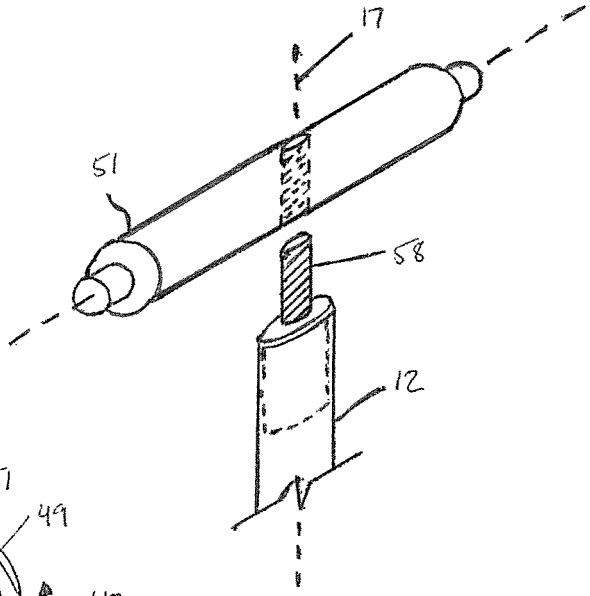
FIG. 2B is an exploded view of the handle of FIG. 2A with an outer body omitted for convenience of illustration.
Figure 2C:
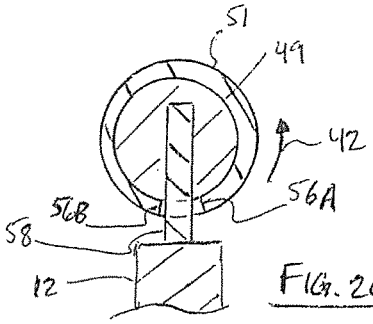
FIG. 2C is a schematic sectional view along a shaft axis of the portion of the arrangement of putter which is shown in FIG. 2A.

Referring to FIGS. 2A-C, in order to provide the swiveling movement of the handle 35 relative to the shaft 12, the handle comprises an inner shaft 49 which defines the handle axis 37 and which is connected in fixed transverse relation to the upright shaft 12 of the putter, and an outer grip 51 which is rotatably supported on the inner shaft for example by a plurality of rotational bearings 52 disposed at axially spaced positions on the inner handle shaft 49 so as to be rotatable relative thereto for effecting the swiveling movement of the handle. Thus the inner shaft 49 acts as an inner support body for an outer body defined by the grip 51. This swiveling movement is guided by a slit which is defined by the outer grip and extends angularly of the handle axis to define the predetermined angular path of the swiveling movement of the handle relative to the upper shaft portion 39, and thereby the predetermined path of the forward swinging movement. That is, the slit 55 extends circumferentially of the outer grip 51 about the handle axis 37 and in a radial plane of the handle axis 37 at a right angle thereto so that the putter head 25 follows a substantially linear path across the forward swinging movement 29 for hitting the golf ball when the handle axis 37 is oriented substantially parallel to the support surface S.

Thus the handle grip 51 is maintained in substantially fixed position when grasped by the user's first leading hand 4 such that there is no relative movement between therebetween, and the handle 35, overall, is held in substantially fixed location, with the handle axis 37 oriented in such a manner that the putter head 25 is aimed for subsequent displacement in the forward swinging movement along the predetermined angular path defined by the handle such that the golf ball is hit in a prescribed direction corresponding thereto the predetermined angular. The shaft 12 and consequently the putter head 25 are displaced by the user's second trailing hand in the forward swinging movement independently of the handle 35, that is, the handle can remain in fixed location without being displaced in any swinging-like movement. The handle axis 35 therefore substantially defines the fulcrum F of the forward swinging movement which is controlled by the user's first hand grasping same.

The swing becomes very simple with the only movement of the user required by one of two hands, and the movement of the shaft is guided and restricted to its predetermined path as defined by the slit.

In the illustrated arrangement, the slit is closed by a pair of its circumferentially opposite ends 56A, 56B so as to form a closed slot and to delimit the swiveling movement. The outer grip 51 can thus be freely rotatable about the inner body 49 as the slot 55 delimits the angular displacement around the handle axis 37. More specifically, slot end 56A which is located angularly forwardly of slot end 56B, relative to a rearward rotational direction 57, defines the starting position of the handle and the slot end 56B defines the trailing ending position of the handle after displaced in rotational swiveling movement. Aside from being restricted in rotational angular displacement, the handle 35 is arranged to freely rotate relative to the shaft 12 about the handle axis 37. In the illustrated arrangement, the outer body 51 is tubular and forms a cylindrical sleeve or shell received coaxially of the inner shaft 49. An upright connector member 58 extends substantially axially of the shaft axis 17 from the upper end 15 of the shaft to the inner shaft 49 of the handle so as to connect the handle to the shaft, and passes through the slot 55 of the outer body 51 so as to cooperate with the slot to restrict the swiveling movement between the starting and ending positions.

As it may be desirable to reduce the change in an angle of attack between the initial contact of the putter head's front face 27 with the ball 1 and that at the end of the swing, the head 25 is pivotally connected to the shaft 12 at a head pivot 61 defining a pivot axis 62 oriented transversely to the shaft axis 17 and substantially parallel to the hitting plane 32 and disposed rearwardly of the front face 27 of the head. The head pivot 61 is located coaxially with the shaft and the handle relative to the shaft axis 17. The front face 27 of the head is movable in pivotal movement relative to the shaft 12 about the pivot axis 62 between a starting position as shown for example in FIG. 3B in which the hitting plane 32 is substantially parallel to the shaft axis 17 and an oblique ending position as shown in FIG. 1 in which the hitting plane 32 is oriented so as to form an acute angle θ with the shaft axis such that the hitting plane 32 can remain substantially normal to the support surface S after initial contact with the golf ball 1 during the forward swinging movement 29. In the illustrated arrangement, the head pivot 61 is formed by a pin 64 oriented along the pivot axis 62 which is operatively interconnected between the head 25 and the lower end 14 of the shaft via an upright interconnection member 65 which includes at its lower end a sleeve 66 which rotatably receives the pin 64. The pin 64 is attached in fixed rotational relation to the head 25 but is rotatable within the sleeve 66 which is attached in fixed rotational relation to the interconnection member 65.

In the illustrated arrangement, the pivot axis 62 is located closer to the rear of the putter head than to the front face 27. The head 25 is formed by a planar generally U-shaped member, such as a horseshoe, with the head pivot 61 connected to a top side thereof. The front face is formed by a block bridging the otherwise disconnected ends of the U-shaped member. The block has a planar front face defining the front face 27 of the putter head.

The handle 35 is arranged for swiveling movement about the handle axis 37 and relative to the upper portion 39 of the shaft 12 from a starting position to a trailing ending position in a rearward rotational direction 57 about the handle axis 37 which is directed as if towards the front face 27 of the head so as to permit restricted relative movement generally between the wrists 7 of the user and the head 25 of the putter during the forward swinging movement 29 for hitting the golf ball 1. As the user is gripping each of the handle 35 and the shaft which are movable relative to one another, the head 25 which moves in generally fixed relation to the shaft 12 in the forward swinging movement is enabled to move in pendulum-like forward swinging movement. The angular displacement 8 of the putter head is substantially equal to an angular displacement of the handle 35 from the starting position to the ending position which is between about four degrees and about ten degrees relative to the handle axis 37 in the rearward rotational direction 56. As the swiveling movement is relatively limited so that the angular displacement of the handle is directly proportional to the angular displacement 8 of the putter head 25, the putter head 25 is preferably over-weighted compared to a conventional putter head so that a shorter swing, that is displacement of the putter head 25 over a shorter arcuate path in the forward swinging movement 29, can still act to generate sufficient force to propel the golf ball 1 the desired distance.

Furthermore, in the illustrated arrangement the pivotal movement of the head 25 from the starting position to the oblique ending position is arranged so as to be responsive to the swiveling movement of the handle 35 from the starting position to the leading ending position thereof. Thus, the handle acts as a controller for controlling the pivotal movement of the head between the starting position and the oblique ending position.

This is achieved by a control assembly for controlling the pivotal movement of the front face 27 of the head between the starting and oblique ending positions. The control assembly of the putter comprises a movable link 67 (schematically shown) which is operatively coupled between the handle 35 and the head 25 at a location thereon indicated at 68 which is rearward of the pivot axis 62 so as to be opposite to the front face 27 relative to the pivot axis 62. The movable link 67 is arranged in a manner so that the swiveling movement of the handle 35 acts to displace the movable link 67 so as to move the front face of the head from the starting position to the oblique ending position. Thus the link 67 spans from the rear 68 of the putter head 25 to the handle 35 along the shaft 12 and is operatively connected to the movable outer handle body 51. As such, the link 67 acts as an actuator whereby the putter head is operable for the pivotal movement between its starting and ending positions responsive to a rotational position provided by a mechanical controller defined by the outer body 51 of the handle. The movable link 67 is disposed within an interior cavity of the shaft and there is provided a pulley in the shaft cavity for guiding the movable link in its path between the handle 35 and the putter head 25. The control assembly includes a resilient tensionable member 70 which is operatively coupled between the head 25 and the upright shaft 12 and arranged to be tensioned when the front face 27 of the head 25 is in the oblique ending position (as in FIG. 1) so as to bias the front face 27 back to the starting position.

Figure 3C:
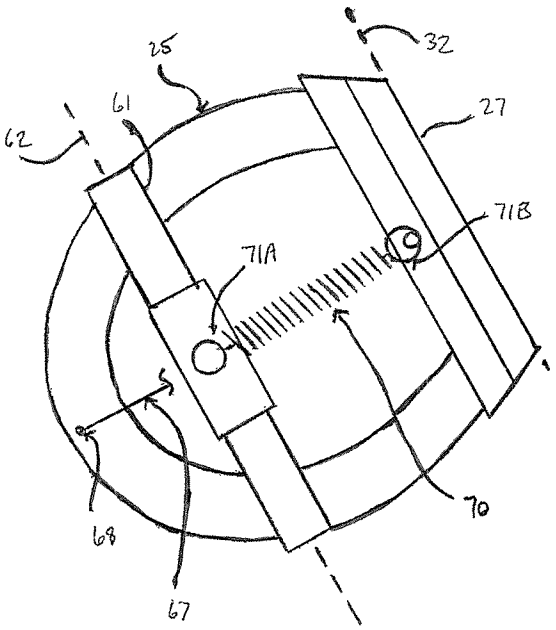
FIG. 3C is a top plan view of the lower portion of FIG. 3A with some components omitted for clarity of illustration.
Figure 3B:
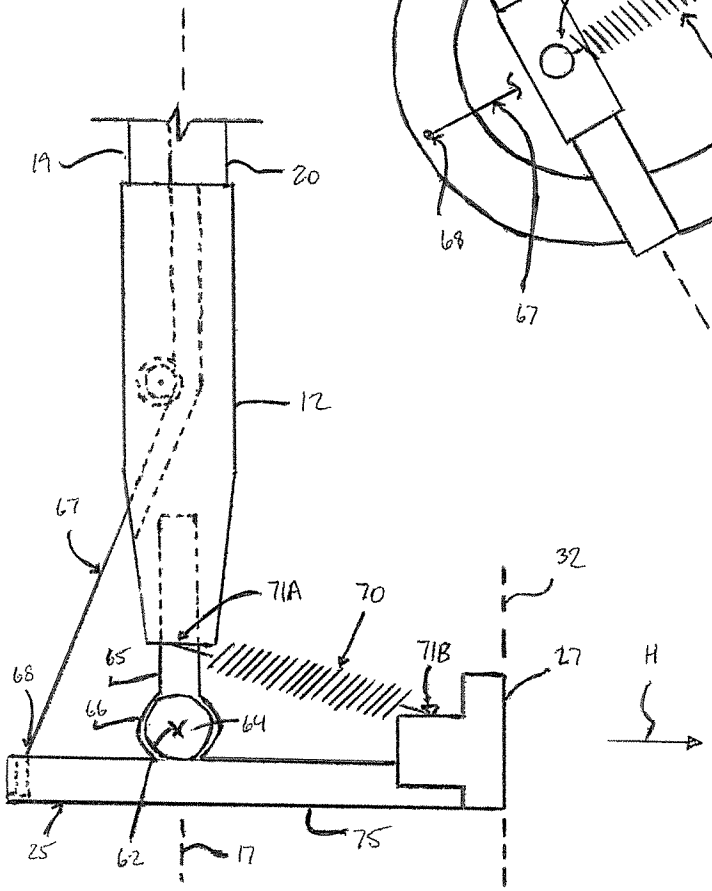
FIG. 3B is a side view of the lower portion of FIG. 3A.
Figure 3A:
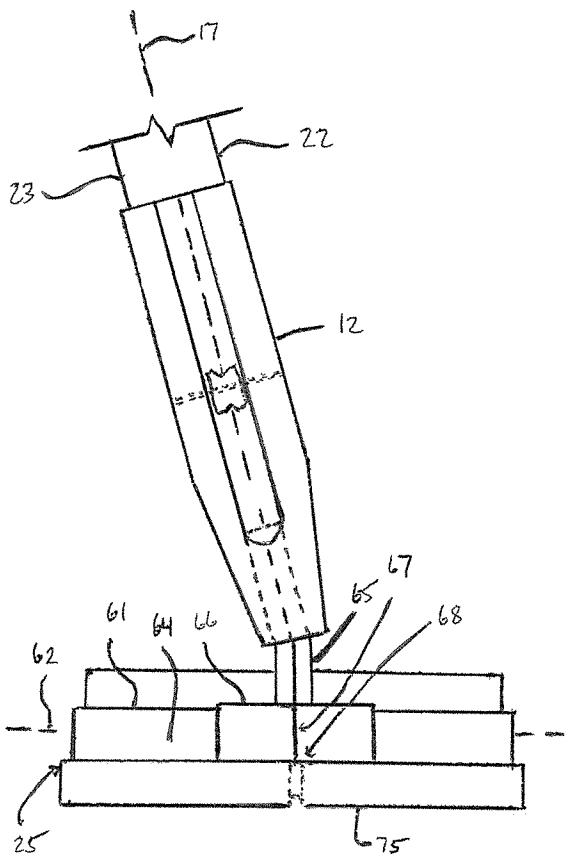
FIG. 3A is a rear view of a first variant of lower portion of the arrangement of FIG. 1.

In the arrangement of FIGS. 3A-3C, the actuating link 67 is formed by a tensionable flexible cable and the resilient tensionable member 70 is in the form of a tension spring (schematically shown) coupled at a first end 71A to the shaft 12 and at a second end 71B to the front face 27 of the head and which, when tensioned such that the spring is stretched, it is arranged to urge its ends back towards one another. In other words, the opposite ends 71A, 71B are displaceable from one another in a longitudinal direction of the member, along which these ends are spaced, for tensioning the member 70. As such, the movable link 67 and resilient member 70 cooperate to orient the front face 27 of the head proportionately to the angular position of the handle 35 relative to handle axis 37.

Figure 6B:
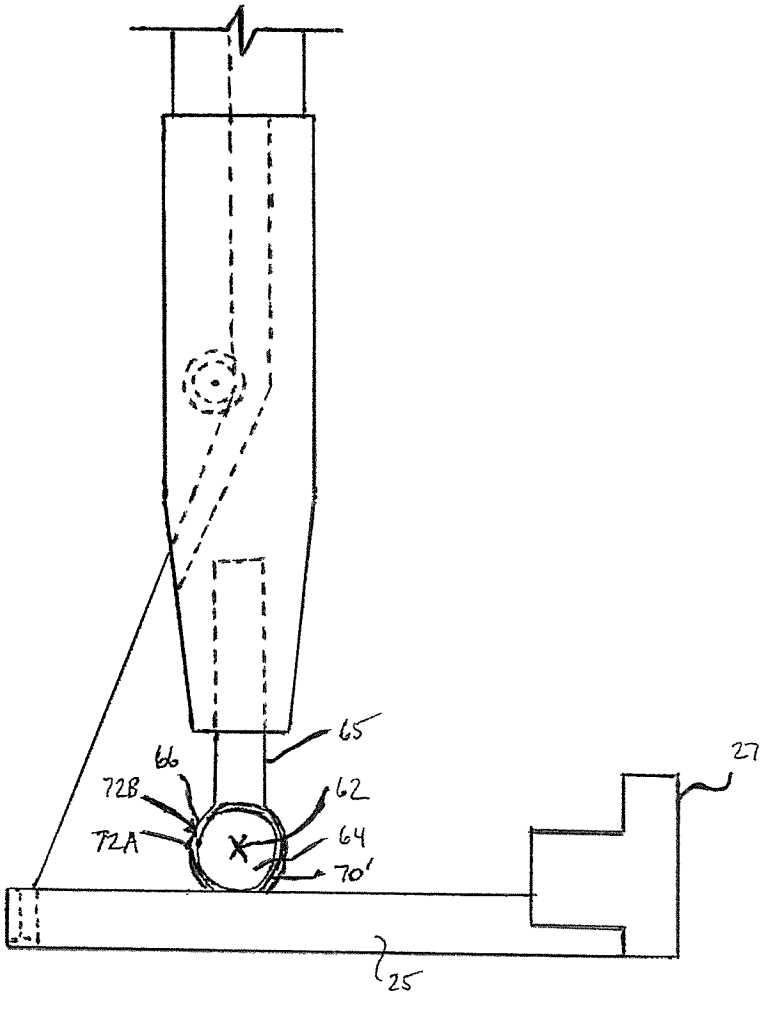
FIG. 6B is a rear view of the lower portion of FIG. 6A.
Figure 6A:
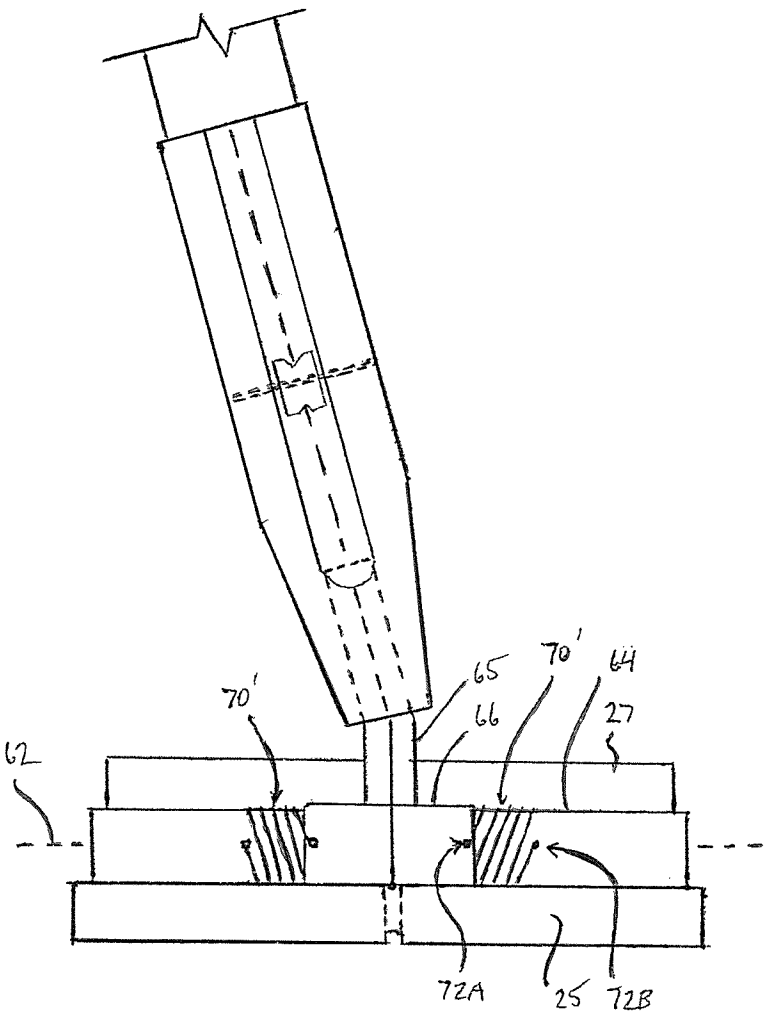
FIG. 6A is a top plan view of a second variant of lower portion of the arrangement of FIG. 1, with some components omitted for clarity of illustration.
Figure 6C:
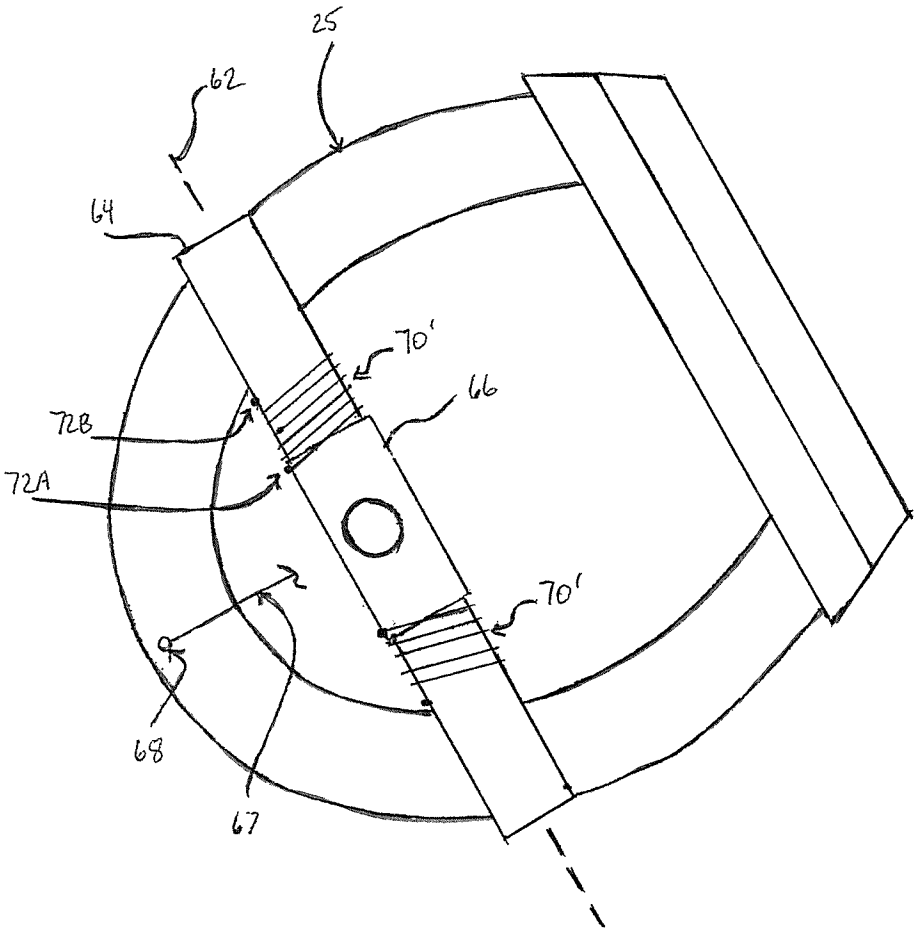
FIG. 6C is a side view of the lower portion of FIG. 6A.

FIGS. 6A-6C show a variant of the control assembly in which the resiliently tensionable member 70' comprises at least one torsion spring (schematically shown) arranged coaxially with the pivot axis 62 of the head pivot 61. More specifically, there are provided a pair of torsion springs 70', one on either side of the shaft 12 received over the pin 64, each of which has one end 72A connected in fixed relation to the sleeve 66 and an opposite end 72B connected in fixed relation to the pin 64 which is rotatably carried inside sleeve 66. The torsion springs 70' are arranged such that when they are twisted around their axes (defined at 62) in a manner which angularly displaces the opposite ends 72A and 72B towards one another in a rotational direction opposite to that traversed by the spring around its axis, the spring is tensioned (and may also be compressed, in accordance with torsional forces) and is arranged to urge its ends 72A, 72B in the opposite rotational direction to the applied twisting (that is, along the path of the spring) back to the neutral condition.

This arrangement allows the user to use the handle to aim the putter head and to displace the shaft, to which the head is attached so as to move therewith in the forward swinging movement, along a predictable path defined by the handle so that the golf ball is hit in a predictable direction defined by the relative movement between the handle and the shaft.

Furthermore, pivotal connection of the putter head 25 as described hereinbefore allows the front face of the putter head to maintain substantially a constant angle of attack relative to the golf ball even after initial contact therewith in the forward swinging movement. In other words, by the pivotal movement of the head, a planar sole or bottom 75 of the putter head 25 which defines a plane oriented normal to the hitting plane 32 may be maintained substantially parallel to the support surface S.

As described herein the present invention relates, in one aspect, generally to a putter which comprises a handle at an upper end of a shaft of the putter to be grasped by one hand of a user, while an upper portion of the shaft between the handle and the head is to be grasped by a second hand of the user. The handle is arranged for swiveling movement relative to the upper shaft portion along a predetermined angular path defined about a transverse handle axis distinct from a shaft axis so that the handle can be fixedly held by the user and the shaft displaced in forward swinging movement along the predetermined angular path to hit the golf ball. In another aspect, the present invention relates generally to a putter head which is pivotally connected at a lower end of the shaft to be movable about a distinct transverse pivot axis between a starting position in which a hitting plane is substantially parallel to the shaft axis and oblique ending position in which the hitting plane forms an acute angle therewith, such that the hitting plane of the head can remain substantially normal to the support surface after initial contact with the golf ball during the forward swinging movement.

The scope of the claims should not be limited by the preferred embodiments set forth in the examples but should be given the broadest interpretation consistent with the specification as a whole.

The invention claimed is:

1. A putter for hitting a golf ball across a support surface comprising:

an upright shaft extending from a lower end to an upper end along a shaft axis, the shaft having intermediate the upper and lower ends a backside and a front side spaced forwardly from the backside;

a head supported at the lower end of the shaft and having a front face arranged generally at the front side of the shaft for engaging the golf ball in a forward swinging movement, the front face defining a hitting plane which is substantially parallel to the shaft axis;

a handle supported at the upper end of the shaft and defining a handle axis oriented transversely to the shaft axis and substantially parallel to the hitting plane for gripping by a first hand of a user in a putting stance of the user so as to orient the hitting plane substantially perpendicularly to the user positioned in the putting stance;

an upper portion of the shaft intermediate the handle and the head adapted for gripping by a second hand of the user;

wherein the handle is arranged for swiveling movement relative to the upper portion of the shaft along a predetermined angular path about the handle axis so that the handle gripped by the first hand of the user can be maintained at a substantially fixed location to define a fulcrum of the forward swinging movement while the shaft is displaced by the second hand in the forward swinging movement along the predetermined angular path for hitting the golf ball in a prescribed direction defined by the predetermined angular path;

wherein the head is pivotally connected to the shaft at a head pivot defining a pivot axis oriented transversely to the shaft axis and substantially parallel to the hitting plane and disposed rearwardly of the front face of the head, the front face of the head being movable in pivotal movement relative to the shaft about the pivot axis between a starting position in which the hitting plane is substantially parallel to the shaft axis and an oblique ending position in which the hitting plane is oriented so as to form an acute angle with the shaft axis such that the hitting plane can remain substantially normal to the support surface after initial contact with the golf ball during the forward swinging movement;

wherein the head is operatively coupled to the handle, so that the pivotal movement of the head is responsive to the swiveling movement of the handle, by a control assembly including:

a link operatively coupled between the handle and the head at a location thereon rearward of the pivot axis and arranged in a manner so that the swiveling movement of the handle acts to displace the link to move the front face of the head from the starting position to the oblique ending position, and a resilient tensionable member operatively coupled between the head and the upright shaft and arranged to be tensioned when the front face of the head is in the oblique ending position so as to bias the front face back to the starting position.

2. The putter of claim 1 wherein the handle comprises an inner support body defining the handle axis and connected in fixed transverse relation to the upright shaft and an outer grip of the handle adapted for gripping by the first hand of the user and swivably supported by the support body for effecting the swiveling movement of the handle, the outer grip defining a slit extending angularly of the handle axis to define the predetermined angular path of the swiveling movement of the handle relative to the upper portion of the shaft.

3. The putter of claim 2 wherein the outer grip is rotatably supported on the inner body so as to be freely rotatable relative thereto around the handle axis and the slit forms a closed slot which is cooperative with an upright connector member extending substantially axially of the shaft axis from the upper end of the shaft to the inner body of the handle to connect the handle to the shaft and passing through the slot of the outer grip to restrict the swiveling movement between starting and ending positions corresponding to opposite ends of the slot.

4. The putter of claim 3 wherein an angular displacement of the handle from the starting position to the ending position is between about four degrees and about ten degrees relative to the handle axis.

5. The putter of claim 1 wherein the resiliently tensionable member comprises longitudinally spaced apart first and second ends which are displaceable away from one another in a longitudinal direction of the member for tensioning the resiliently tensionable member, wherein the first end is coupled to the upright shaft and the second end is coupled to the head forwardly of the pivot axis.

6. The putter of claim 1 wherein the resiliently tensionable member comprises a spring arranged coaxially of the pivot axis with one end connected in fixed relation to the upright shaft and another end connected in fixed relation to the head and the spring is configured to be twisted around its axis for tensioning the spring.

7. The putter of claim 1 wherein the handle is disposed at the end of the shaft and forms an elongate member extending along the shaft axis so as to generally collectively form a T-shape with the upper portion of the shaft.

8. A putter for hitting a golf ball across a support surface comprising:

an upright shaft extending from a lower end to an upper end along a shaft axis, the shaft having intermediate the upper and lower ends a backside and a front side spaced forwardly from the backside;

a head supported at the lower end of the shaft and having a front face arranged generally at the front side of the shaft for engaging the golf ball in a forward swinging movement, the front face defining a hitting plane which is substantially parallel to the shaft axis;

an upper portion of the shaft distal to the head being arranged for gripping by a user such that the hitting plane is oriented substantially perpendicularly to the user positioned in a putting stance;

wherein the head is pivotally connected to the shaft at a head pivot defining a pivot axis oriented transversely to the shaft axis and substantially parallel to the hitting plane and disposed rearwardly of the front face of the head, the front face of the head being movable in pivotal movement relative to the shaft about the pivot axis between a starting position in which the hitting plane is substantially parallel to the shaft axis and an oblique ending position in which the hitting plane is oriented so as to form an acute angle with the shaft axis such that the hitting plane can remain substantially normal to the support surface after initial contact with the golf ball during the forward swinging movement;

wherein the upper portion of the shaft comprises a handle supported at the upper end of the shaft and defining a handle axis oriented transversely to the shaft axis and substantially parallel to the hitting plane for gripping by a first hand of a user such that the hitting plane is oriented substantially perpendicularly to the user in the putting stance, and wherein the upper portion of the shaft intermediate the handle and the head is adapted for gripping by a second hand of the user;

wherein the handle is arranged for swiveling movement relative to the upper portion of the shaft from a starting position to an ending position in a rotational direction about the handle axis so as to permit restricted relative movement between wrists of the user's hands and the head of the putter during the forward swinging movement for hitting the golf ball; and wherein the head is operatively coupled to the handle, so that the pivotal movement of the head is responsive to the swiveling movement of the handle, by a control assembly including:

a link operatively coupled between the handle and the head at a location thereon rearward of the pivot axis and arranged in a manner so that the swiveling movement of the handle acts to displace the link to move the front face of the head from the starting position to the oblique ending position, and a resilient tensionable member operatively coupled between the head and the upright shaft and arranged to be tensioned when the front face of the head is in the oblique ending position so as to bias the front face back to the starting position.

9. The putter of claim 8 wherein the resiliently tensionable member comprises longitudinally spaced apart first and second ends which are displaceable away from one another in a longitudinal direction of the member for tensioning the resiliently tensionable member, wherein the first end is coupled to the upright shaft and the second end is coupled to the head forwardly of the pivot axis.

10. The putter of claim 8 wherein the resiliently tensionable member comprises a spring arranged coaxially of the pivot axis with one end connected in fixed relation to the upright shaft and another end connected in fixed relation to the head and the spring is configured to be twisted around its axis for tensioning the spring.

* * * * *